US006872469B2

(12) United States Patent
Fujibayashi et al.

(10) Patent No.: US 6,872,469 B2
(45) Date of Patent: Mar. 29, 2005

(54) ALLOYED ZINC DIP GALVANIZED STEEL SHEET

(75) Inventors: Nobue Fujibayashi, Kurashiki (JP); Kazuaki Kyono, Kurashiki (JP)

(73) Assignee: JFE Steel Corporation, Tokyo (JP)

( * ) Notice: Subject to any disclaimer, the term of this patent is extended or adjusted under 35 U.S.C. 154(b) by 102 days.

(21) Appl. No.: 10/240,550

(22) PCT Filed: Feb. 4, 2002

(86) PCT No.: PCT/JP02/00876

§ 371 (c)(1),
(2), (4) Date: Oct. 2, 2002

(87) PCT Pub. No.: WO02/063057

PCT Pub. Date: Aug. 15, 2002

(65) Prior Publication Data

US 2003/0168134 A1 Sep. 11, 2003

(30) Foreign Application Priority Data

Feb. 5, 2001 (JP) ..... 2000-28379

(51) Int. Cl.[7] ..... B32B 15/18; C22C 38/02; C22C 36/60

(52) U.S. Cl. ..... 428/659; 148/320

(58) Field of Search ..... 428/659; 148/320, 148/533

(56) References Cited

U.S. PATENT DOCUMENTS 4,368,084 A * 1/1983 Irie et al. ..... 148/505
5,049,453 A * 9/1991 Suemitsu et al. ..... 428/629

FOREIGN PATENT DOCUMENTS

JP 4-41658 * 2/1992 ..... C21D/9/48
JP 406081044 * 3/1994 ..... 148/504
JP 8-232045 A 9/1996
JP 9-111432 A 4/1997
JP 409235652 * 9/1997 ..... C22C/38/00
JP 11-269625 A 10/1999

* cited by examiner

*Primary Examiner*—Deborah Yee
(74) *Attorney, Agent, or Firm*—Young & Thompson

(57) ABSTRACT

A galvannealed steel sheet having excellent surface appearance and press formability, characterized in that a steel sheet comprises a galvannealed layer at least one surface of the steel sheet, the steel sheet comprising 0.001 to 0.005% by mass of C, 0.010 to 0.040% by mass of Si, 0.05 to 0.25% by mass of Mn, and 0.010 to 0.030% by mass of P, wherein the Si, Mn, and P satisfy the relation 0.030%≦Si+P+Mn/20≦0.070%, and its production method.

6 Claims, 3 Drawing Sheets

ALLOYED ZINC DIP GALVANIZED STEEL SHEET

TECHNICAL FIELD

The present invention relates to a galvannealed steel sheet for use in an automobile steel sheet (including steel strip). More particularly, the present invention relates to a galvannealed steel sheet (hereinafter may be referred to as "GA") having a surface appearance with no non-coating, ripple, galvannealing non-uniformity, and having excellent press formability (powdering resistance, friction property), and its production method.

BACKGROUND ART

Galvannealed steel sheets are low price, have excellent rust prevention property, and therefore are widely used as automobile steel sheets. The galvannealed steel sheet is required to have not only excellent corrosion resistance, but also a good surface appearance, powdering resistance, and friction property upon press forming.

Poor surface appearance in the GA includes non-coating, ripple, and galvannealing non-uniformity. The non-plating means that a non-coating portion exists on the steel sheet, which should be avoided since the appearance is damaged, and the rust prevention property is adversely affected. It is conventionally known that the non-coating is easily produced when an alloy element such as Si, Mn and P is increased for strengthen the steel sheet, these strengthen elements are produced on the surface of the steel sheet as oxides in annealing prior to coating, to decrease wettability between the steel sheet and zinc.

Even if the coating is deposited on the steel sheet, a too large amount of the coating is deposited on a portion where the coating is considered to be deposited together with an oxidized film on a surface of a coating bath. Such portion has a different color from other portions, and is convex. As a result, appearance non-uniformity is observed, and is referred to as the ripple. In a galvannealing treatment, the portion where the oxides are deposited has a different galvannealing rate from those of the other portions. The portion has the larger amount of the plating, and has a convex surface so that the portion is in a white color, which is different from that of the other portions. The ripple is easily produced when strengthen elements are increased, similar to the non-coating. It is considered that the ripple is produced by an effects of the oxide of the strengthen element produced on the surface of the steel sheet so that the oxidized film on the surface of the coating bath is easily deposited on the steel sheet.

The galvannealing non-uniformity is produced by a difference in galvannealing rates. A difference in color is produced on the GA surface since a not-galvannealed portion remains. An irregular color appearance is observed. The galvannealing rate largely depends on a galvannealing temperature and an Al concentration in the coating bath.

On the other hand, coating layer properties largely depends on the press formability of the galvannealed steel sheet. In the GA, a Zn—Fe alloy coating phase is produced by a diffusion of zinc and steel sheet (Fe). A $\Gamma$ phase (including a $\Gamma$ phase and a $\Gamma_1$ phase) is produced at a steel sheet side of the coating layer, and a $\zeta$ phase is produced at the surface of the coating layer. The $\Gamma$ phase has high Fe content, and is hard and brittle, which inhibits tight coating adhesion, and especially becomes a factor of a coating peel, which is called powdering, upon the press forming. The $\zeta$ phase is soft, which inhibits the friction property upon the press forming, and becomes a factor of a press crack.

Conventionally, a number of attempts have been made in order to improve the surface appearance and the press formability as described above.

For example, as to non-coating and the ripple caused by the decrease in the wettability between the steel sheet and zinc, Japanese Unexamined Patent Application Publication No. 7-70723 proposes a method for coating by concentrating components in a steel sheet on a surface of the steel sheet with annealing, removing a layer thus-concentrated with pickling, and then heating again. However, since the method needs two times of annealing and pickling steps, the costs inevitably increase.

As to the galvannealing non-uniformity, Japanese Unexamined Patent Application Publication No. 5-132748 proposes a method for regulating the amount of Al in the bath by the amount of Ti and P in the steel. However, the contents of the elements in the steel differ depending on a tapping steel. It is extremely difficult to change the amount of Al in the bath in response thereto. It will also be disadvantage in the cost point of view.

In order to improve the non-coating, the galvannealing non-uniformity, and the powdering resistance, Japanese Unexamined Patent Application Publication No. 6-88187 proposes a method for forming a metal coating layer made of Fe, Ni, Co, Cu and the like on a steel sheet after annealing but before coating. However, a normal continuous galvannealing line includes no facility to produce the metal coat after the annealing and before plating. It requires to newly provide the facility. It is difficult to conduct the method that requires the coat forming process.

As to the friction property improvement, Japanese Unexamined Patent Application Publication No. 1-319661 discloses a method for iron-based electrogalvanizing on an upper layer of a galvannealed steel sheet. However, in the method, the electrogalvanizing step is needed extra in addition to the normal production steps of the galvannealed steel sheet. It makes the steps complex, and increases the costs.

As to the powdering resistance and friction property (stability of a friction coefficient within a coil) improvement, Japanese Unexamined Patent Application Publication No. 9-165662 indicates that a high temperature galvannealing at 495° C. or more and at 520° C. or less, with a bath temperature of 470° C. or less, a high immersed sheet temperature, whereby a production of a soft $\zeta$ phase is inhibited and galvannealing is performed microscopically to provide excellent powdering resistance. Japanese Unexamined Patent Application Publication No. 9-165663 indicates that the similar effects are obtained by a low bath temperature of 460° C. or less, and a high temperature galvannealing at 495° C. or more and 520° C. or more.

However, in the operation in which the bath temperature and the immersed sheet temperature is different, the coating bath temperature is not stabilized, and a production of a dross is increased by a change in the bath temperature and a bath temperature difference between a steel sheet and the other portions. The dross is attached to the steel sheet, resulting in a poor appearance. When the steel sheet is immersed in the bath at high temperature or at low temperature, the bath temperature increases or decreases by a heat transfer between the steel sheet and the coating bath. In order to stabilize the bath temperature, it is required to provide a temperature control device and the like for cooling or heating the coating bath at lower or higher than the normally required.

Thus, the conventional methods for improving the surface appearance and the press formability of the galvannealed steel sheet unfavorably requires new steps and facilities, and lacks the stability in the coating operation.

An object of the present invention is to provide a galvannealed steel sheet with excellent surface appearance and press formability, and its production method, that can solve the aforementioned conventional problems upon the galvannealed steel sheet production.

DISCLOSURE OF INVENTION

The present inventors considered that a difference in galvannealing rate due to a different coil, i.e., a difference in the amount of minor elements in a steel sheet, affects the surface appearance and the press formability of the galvannealed steel sheet, with a production of galvannealing non-uniformity regardless of rapid change in an Al content in a coating bath taking into consideration. The present inventors experimented and studied for detail in view of a composition of the steel sheet. As a result, it has been discovered that it is significantly important to adjust contents of Si, Mn and P so that a predetermined relation is satisfied for solving the aforementioned problems, and the present invention has been achieved. The subject matters of the present invention as follows:

(1) A galvannealed steel sheet having excellent surface appearance and press formability, characterized in that a steel sheet comprises a galvannealed layer at least one surface of the steel sheet, the steel sheet comprising 0.001 to 0.005% by mass of C, 0.010 to 0.040% by mass of Si, 0.05 to 0.25% by mass of Mn, and 0.010 to 0.030% by mass of P, wherein the Si, Mn, and P satisfy the relation $0.030\% \leqq Si+P+Mn/20 \leqq 0.070\%$.

(2) A galvannealed steel sheet having excellent surface appearance and press formability in (1), wherein the steel sheet further comprises one or two of 0.010 to 0.060% by mass of Ti and 0.005 to 0.040% by mass of Nb.

(3) A galvannealed steel sheet having excellent surface appearance and press formability in (2), wherein the Ti and Nb satisfy the relation $0.015\% \leqq Ti+Nb \leqq 0.050\%$, and $0.010\% \leqq Ti-(48C/12+48S/32+48N/14)$.

(4) A galvannealed steel sheet having excellent surface appearance and press formability in any one of (1) to (3), wherein the steel sheet further comprises 0.001 to 0.10% by mass of Sb.

(5) A galvannealed steel sheet having excellent surface appearance and press formability in any one of (1) to (4), wherein the layer deposits in the amount of 25 to 60 g/m$^2$, contains 9 to 14% of Fe, and has a ζ phase with a thickness of 0.5 μm or less, and a Γ phase with a thickness of 1.5 μm or less.

(6) A method for producing a galvannealed steel sheet having excellent surface appearance and press moldability, comprising the steps of galvannealing at least one surface of a steel sheet, and alloying at a temperature ranging from 500 to 520° C.; the steel sheet comprising 0.001 to 0.005% by mass of C, 0.010 to 0.040% by mass of Si, 0.05 to 0.25% by mass of Mn, and 0.010 to 0.030% by mass of P, wherein the Si, Mn, and P satisfy the relation $0.030\% \leqq Si+P+Mn/20 \leqq 0.070\%$.

BEST MODE FOR CARRYING OUT THE INVENTION

Firstly, an important discovery according to the present invention will be described. The present inventors examined an effect of the elements in the steel on the galvannealing rate. As an indicator of the galvannealing rate, there was used an galvannealing temperature (critical galvannealing temperature) at which the galvannealing is completed for a holding time of 12 seconds, i.e., the content of Fe in the galvannealing layer exceeds 8%. This is based on the fact that non-galvannealing (galvannealing non-uniformity) occurs and the productivity becomes poor, if it takes more time to complete the galvannealing.

Figure 1:
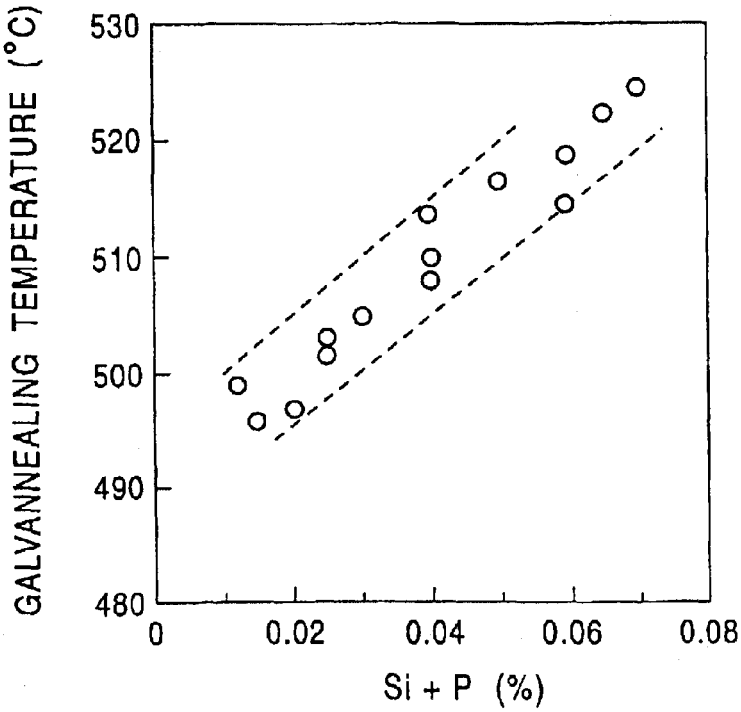
FIG. 1 is a graph showing a relation between a galvannealing temperature and Si+P in a steel sheet.
Figure 2:
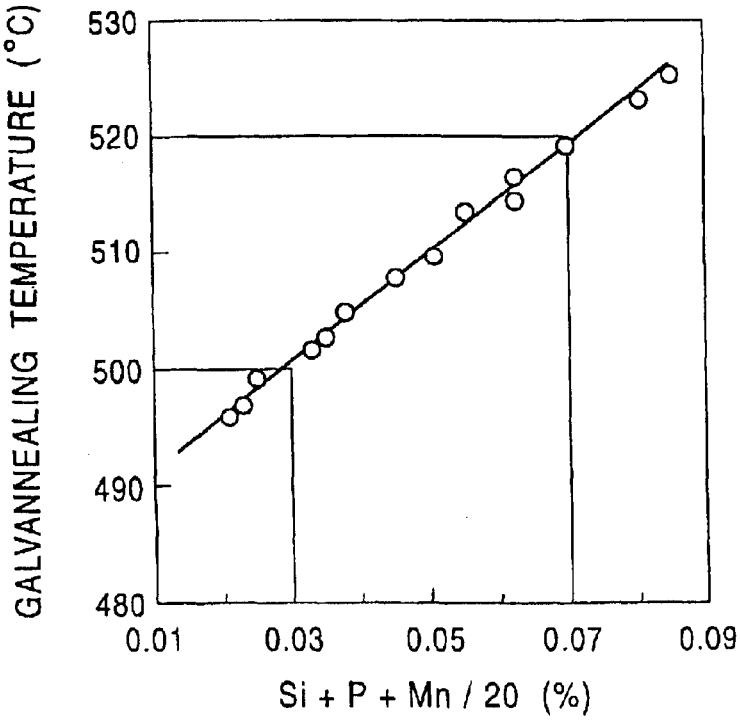
FIG. 2 is a graph showing a relation between a galvannealing temperature and Si+P+Mn/20 in a steel sheet.

Steel sheets having different contents of alloy elements were galvannealed to find a relation with their galvannealing temperatures. As a result, the galvannealing temperature tends to increase as Si+P increases as shown in FIG. 1, but there is no correlative relation. Then, the relation was reconsidered using a parameter with the Mn content taking into consideration as shown in FIG. 2. There is a tight relation with Si+P+Mn/20. It was found that as the Si+P+Mn/20 increased, the galvannealing was delayed linearly.

It seems that such tendency arises from suppression of a diffusion rate of Fe by a surface enrichment of Si and Mn oxides and intergranular segregation of P, similar to the case of the non-coating and the ripple defects.

The difference in the galvannealing temperatures changes the coating adhesion and friction property.

Figure 3:
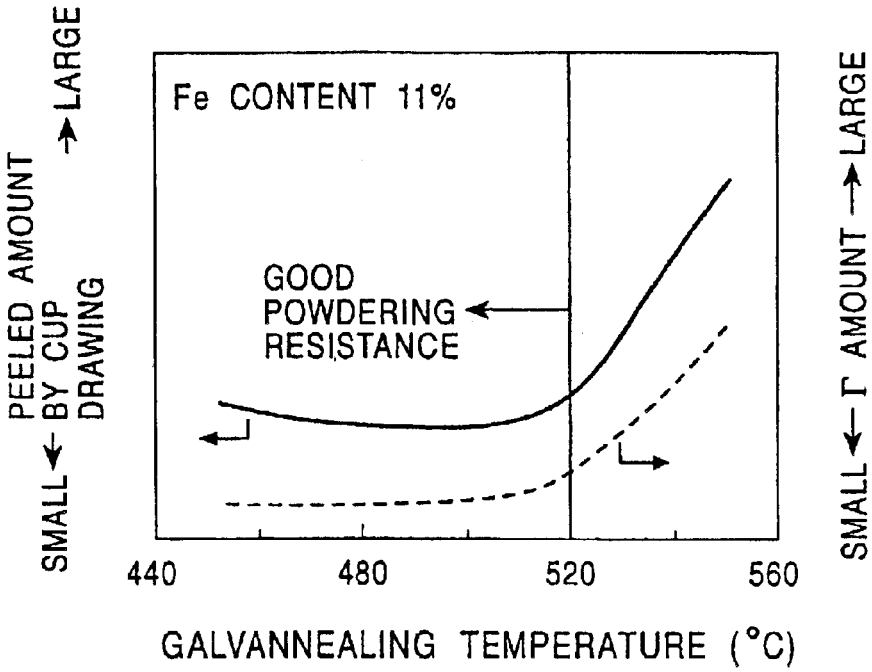
FIG. 3 is a graph showing an effect of a galvannealing temperature on a peeled amount by a cup drawing and on a Γ amount.
Figure 4:
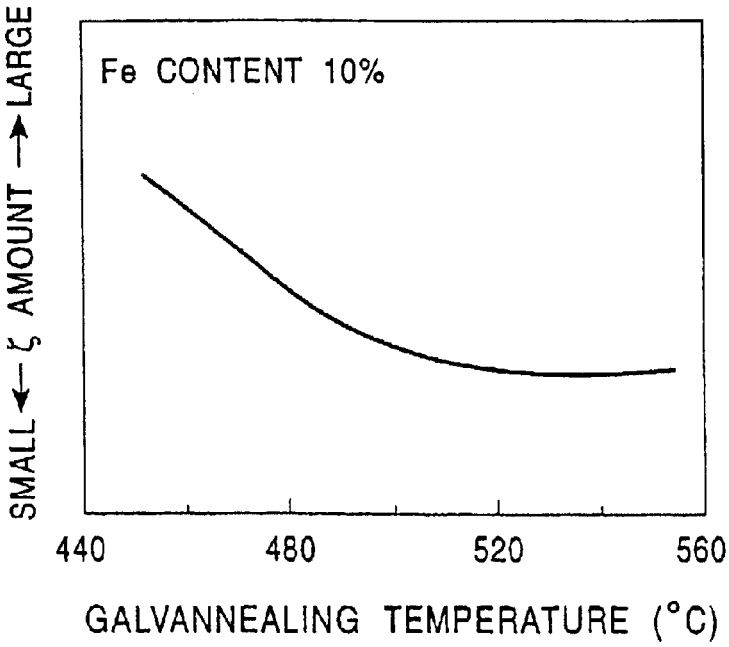
FIG. 4 is a graph showing an effect of a galvannealing temperature on a ζ amount in a plating layer.

For evaluating the adhesion, a peeled amount of the coating was determined by a cup drawing test. FIG. 3 shows the results. When the galvannealing temperature exceeds 520° C., the peeled amount of the coating is increased, and the coating adhesion is decreased. The amount of the Γ phase is also increased. It can be considered that convex and concave portions at an interface is decreased to weaken the adhesion, since the Γ phase is produced in a layer shape at an interface with the steel sheet, when the galvannealing is conducted at high temperature of more than 520° C. As shown in FIG. 4, when the galvannealing temperature decreases less than 500° C., the soft ζ phase is easily produced to deteriorate the friction property. Furthermore, in order to prevent the galvannealing non-uniformity, it is required to complete the galvannealing within a certain galvannealing temperature range. Through an analysis of the operation conditions by the present inventors, it was discovered that a difference of the critical galvannealing temperatures should be within 20° C. in order to avoid the galvannealing non-uniformity.

In summarizing the above discoveries, the galvannealing temperature should be 500° C. or more and 520° C. or less in order to provide both the adhesion and the friction property, and avoid the coating non-uniformity. To obtain the galvannealing temperature of 500° C. or more and 520° C. or less, the contents of Si, Mn and P in the steel sheet should satisfy the relation $0.030\% \leqq Si+P+Mn/20 \leqq 0.070\%$ as shown in FIG. 2.

Figure 5:
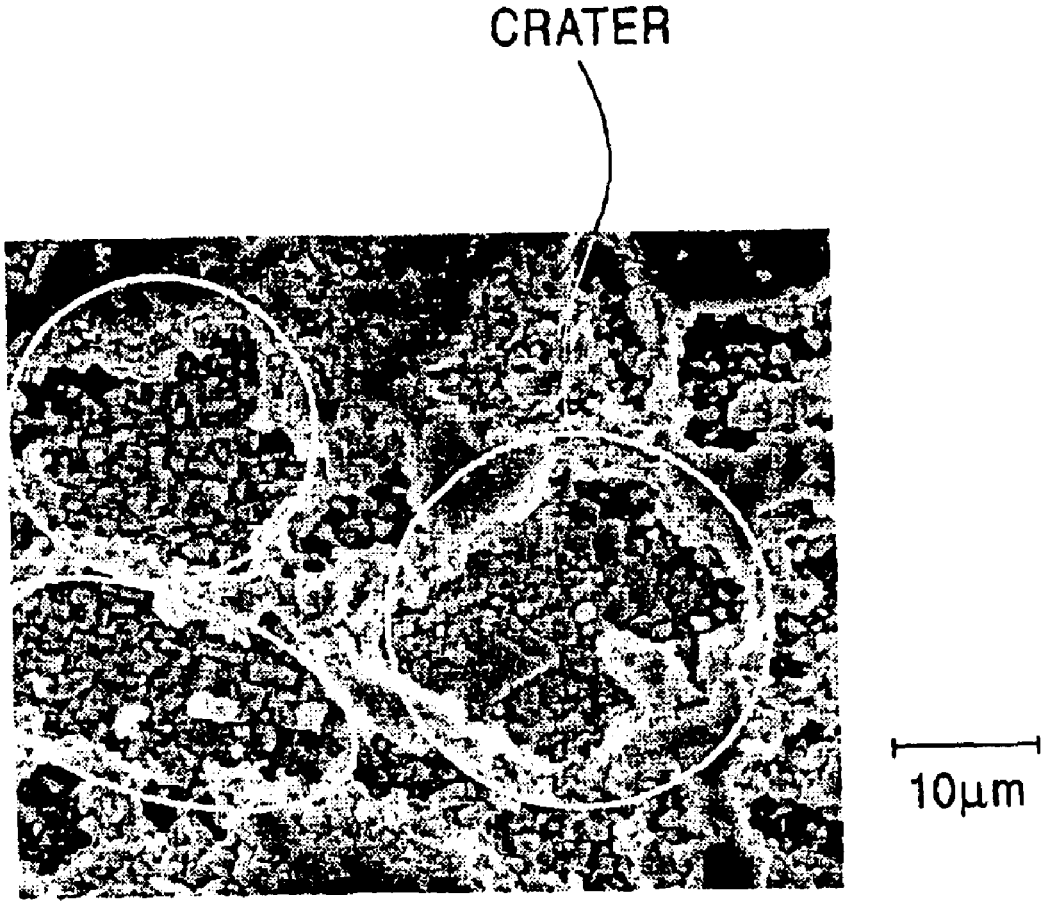
FIG. 5 is a metallograph of illustrative craters observed on a surface of a galvannealed steel sheet.

In addition, through the studies by the present inventors, it was observed that the friction property differed, when the contents of the elements in the steel sheet changed, even if the ζ amount was the same in the coating layer. A mechanism of the friction property difference was examined. It was found that shapes of the GA surface, i.e., numbers of craters produced on the surface, were different. It was discovered that the numbers of the craters were decreased by increasing the amount of Si, Mn, and P in the steel sheet, and that the craters could be controlled by controlling the addition amounts of the strengthen elements in the steel sheet. The craters herein means thinner portions of the coating layer observed by SEM (scanning electron microscope) and the like. In most cases, they correspond to crystal grains of the steel sheet. FIG. 5 shows illustrative craters (SEM image).

A production mechanism of the craters will be considered as follows:

When the contents of Si, P, and Mn in the steel sheet are high, the Si and Mn surface oxides at grain boundary and grain boundary segregation of P are produced preferentially. The diffusion of iron at grain boundary is inhibited so that convex portions are difficult to be formed, and a smooth surface is formed. On the other hand, when the contents of the elements that inhibit the diffusion at intergranular boundary are low, the diffusion rate of iron is high at intergranular boundary as compared to within grains. An alloy phase called an outburst is produced at the intergranular boundary. The alloy phase also takes Zn within grains slowly diffused to produce the convex portions. Within the slowly diffused grains, the alloy phase less and slowly develops to form concave portions (craters). It can be considered that the convex and concave portions thus produced on the GA surface affect as a file upon sliding, increase frictional resistance, and deteriorate the friction property.

It was also found that 0.010% or more of Si, 0.05% by mass or more of Mn, and 0.010% by mass or more of P were required in order not to produce such craters.

Next, the reasons for limiting the contents of each elements will be described.

C: 0.001 to 0.005%

C can decrease deep drawability when a large amount of C is contained. The content of C is 0.005% or less. The lower limit is 0.001% in order to assure some degree of strength in the steel sheet, with a decarburization limit during the normal operation taking into consideration.

Si: 0.010 to 0.040%

If the content of Si exceeds 0.040%, the non-coating or the ripple are produced. It should be 0.040% or less. On the other hand, if the content of Si is less than 0.010%, too large numbers of the aforementioned crater are formed on the GA surface, or the total crater area is too great to decrease the friction property. The content of Si should be 0.010% or more.

Mn: 0.05 to 0.25%

If the content of Mn exceeds 0.25%, the non-coating or the ripple are produced, it should be 0.25% or less. If the content of Mn is less than 0.05%, too large numbers of the aforementioned crater are formed on the GA surface, or the total crater area is too great to decrease the friction property. The content of Mn should be 0.05% or more.

P: 0.010 to 0.030%

If the content of P exceeds 0.030%, the non-coating or the ripple are produced, it should be 0.030% or less. If the content of P is less than 0.010%, too large numbers of the aforementioned crater are formed on the GA surface, or the total crater area is too great to decrease the friction property. The content of P should be 0.010% or more. Preferably, the content of P is 0.012% or more, more preferably 0.015% or more.

As described above, in order to have adhesion and friction property, and not to produce the galvannealing non-uniformity, these Si, Mn and P are most suitably galvannealed at a temperature ranging from 500 to 520° C. Accordingly, the relation $0.030\% \leqq Si+P+Mn/20 \leqq 0.070\%$ should be satisfied.

Ti: 0.010 to 0.060%, Nb: 0.005 to 0.040%

Ti is an element for forming a carbonitride, and Nb is an element for forming a carbide. They are added to improve deep drawability as required. If the content of Ti is less than 0.010%, and the content of Nb is less than 0.005%, the effects are insufficient. The content of Ti should be 0.010% or more, and the content of Nb should be 0.005% or more. If they are added excessively, the effects are saturated. The upper limit of Ti is 0.060%, and the upper limit of Nb is 0.040%. It is more preferable that Ti be contained within the range of 0.010 to 0.35%. In view of a decrease in anisotropy, it is effective to contain 0.005 to 0.030% Nb. $0.015\% \leqq Ti+Nb \leqq 0.050\%$, and $0.010\% \leqq Ti-(48C/12+48S/32+48N/14)$ It is required to limit excess Ti that affects the galvannealing speed in order to more severely limit the galvannealing non-uniformity. It is preferable that Ti is contained to satisfy the relation $0.015\% \leqq Ti+Nb \leqq 0.050\%$, and $0.010\% \geqq Ti-(48C/12+48S/32+48N/14)$ Sb: 0.001 to 0.10%

Sb is a useful element to inhibit nitriding when slab heating, and when heating under reducing atmosphere, and to inhibit a curing of an outermost surface of the steel sheet. Sb can be added as required. The nitriding is inhibited with 0.001% or more of Sb. If more than 0.10% of Sb is added, the effects are saturated. The upper limit of Sb is 0.10% or less.

In addition to the above-described components, B, Ca, REM and the like may be added to the steel sheet, as required. B is segragated at grain boundary, and is an element for improving secondary elaboration brittleness resistance. If more than 0.001% of B is added, the effects are saturated. It is desirable that 0.001% or less of B be added.

At least one surface of the steel sheet comprising the above-described composition is subjected to galvannealing. A deposit amount of a coating layer should be 25 $g/m^2$ per surface to assure the rust prevention property, but 60 $g/m^2$ or less to maintain the powdering resistance. It is preferable that the content of Fe (average value of the coating layer such as the Γ phase and the ζ phase) be 9% or more for losing a η phase sufficiently, and decreasing the ζ phase. On the other hand, it is preferable that the content of Fe be 14% or less for assuring the powdering resistance. Furthermore, in view of the friction property, the ζ phase of the coating layer has a thickness of 0.5 μm or less determined by a controlled potential measurement. The thinner the ζ phase is, the better the friction property is. However, it is difficult to be 0 μm. In view of the powdering resistance, the Γ phase preferably has a thickness of 1.5 μm or less determined by the controlled potential measurement. The thinner the Γ phase is, the better the powdering resistance is. However, it is difficult to be 0 μm.

The conditions used for the controlled potential measurement for determining the thicknesses of the ζ and Γ phases were as follows:

Electrolyte 10%: $ZnSO_4$–20% NaCl solution
Reference electrode: saturated calomel electrode
Counter electrode: platinum
Potential: thickness of the ζ phase: −930 mV
thickness of the Γ phase: dissolved at −860 mV, and then −825 mV Quantity of electricity was measured until a positive current at each potential did not flow (or dissolution of the ζ or Γ phase was completed).

The thicknesses of the ζ and Γ phases were determined based on electrochemical equivalent using the following equation:

$$\text{Thickness of } \zeta \text{ or } \Gamma \text{ phase } (\mu m) = A/S \times (M/2)/(F \times \rho) \times 10^{-6}$$

where A: quantity of electricity measured(C)

S: dissolved area ($m^2$)

M/2: average equivalent of coating phase 64.4/2 (g/mol)

F: Faraday constant 96500 (C/mol)

ρ: ζ phase density: $7.15 \times 10^6$ ($g/m^3$)

Γ phase density: $7.36 \times 10^6$ ($g/m^3$)

The galvannealed steel sheet according to the present invention can be manufactured by producing an ultra low carbon cold-rolled steel sheet using a normal method, and galvanizing and galvannealing it. In these steps, for example, the cold-rolled steel sheet is desirably cleaned by removing the rust preventative oil and the like. The annealing step is conducted at a temperature set to complete recrystallization under reducing atmosphere. Thus, when the steel sheet is immersed in the coating bath, a production of iron oxides should be as low as possible. The coating bath contains about 0.13 to 0.15% of Al, and preferably has a temperature of about 450 to 490° C. More preferably, the coating bath contains 0.135 to 0.145% of Al, and has a temperature of 455 to 475° C. In the subsequent galvannealing treatment, the holding temperature should be 500 to 520° C. The holding time is desirably 10 to 15 seconds.

EXAMPLE

Each steel containing the components shown in Tables 1 and 2 was melted in a converter, and continuous cast into a slab with a thickness of 230 mm. The slab was again heated at 1150° C. for 60 minutes, and hot-rolled to a hot-rolled coil having a thickness of 4 mm at a finished temperature (FDT) of 900° C. and at a coiling temperature (CT) of 500° C. Then, iron oxides thereon were dissolved and removed in a pickling line. The coil was cold-rolled to provide a cold-rolled steel sheet having a thickness of 0.7 mm. The cold-rolled steel sheet was recrystallized and annealed in a continuous galvannealing line (CGL) at a dew point of −30° C., and an annealing temperature of 800 to 850° C. Thereafter, the sheet was immersed in a coating bath containing 0.135 to 0.140% of Al at a temperature of 460° C. to 470° C. to conduct galvannealing. The immersing temperature was also set to 460 to 470° C., and a coating weight was adjusted by wiping. Then, the temperature and the time were changed as required to conduct the galvannealing treatment to produce the galvannealed steel sheet.

The resultant GA steel sheet was measured for the coating weight, the Fe content in the coating layer, the thicknesses of the ζ and Γ phases, the non-coating, the ripple, the galvannealing non-uniformity, the powdering resistance, and the friction property (friction coefficient). These items were measured and evaluated as follows:

Non-coating, ripple: the amount was visually observed and evaluated.

○: none, Δ: a little, x: exist

Galvannealing non-uniformity: visually observed and evaluated.

○: none, Δ: a little non-galvannealed portions, x: exist

Thicknesses of ζ and Γ phases

Electrolyte 10%: $ZnSO_4$-20% NaCl solution

Reference electrode: saturated calomel electrode

Counter electrode: platinum

Potential: thickness of the ζ phase: −930 mV thickness of the Γ phase: dissolved at −860 mV, and then −825 mV Quantity of electricity was measured until a positive current at each potential did not flow (dissolution of the ζ or Γ phase was completed).

The thicknesses of the ζ and Γ phases were determined based on electrochemical equivalent using the following equation:

When the η phase remains as the alloying non-uniformity, a thickness of the η+ζ phases is taken at −930 mV.

$$\text{Thickness of } \zeta \text{ or } \Gamma \text{ phase } (\mu m) = A/S \times (M/2)/(F \times \rho) \times 10^{-6}$$

where A: quantity of electricity measured(C)

S: dissolved area ($m^2$)

M/2: average equivalent of coating phase 64.4/2 (g/mol)

F: Faraday constant 96500 (C/mol)

ρ: ζ phase density: $7.15 \times 10^6$ ($g/m^3$)

Γ phase density: $7.36 \times 10^6$ ($g/m^3$)

Powdering Resistance:

To the sheet, 1.5 $g/m^2$ of a press oil was applied. A cup drawing was conducted with a blank diameter of 60 mmϕ, and a punch diameter of 33 mmϕ (a drawing ratio of 1.82) using an Erichsen tester. An outer circumference of the cup was peeled with an adhesive tape to visually observed and evaluated a photographic density.

Photographic density 1: less peeled, . . . , 5: largely peeled

Friction Property (Friction Coefficient)

The sheet was sheared at a 10 mm width in a rolling direction, was removed burrs, and applied a press oil of 1.5 $g/m^2$ per one side. The friction test was conducted using a flat plate friction tester at a sliding speed of 1000 mm/min, a surface pressure of 4 $kg/mm^2$, and a sliding distance of 50 mm. The friction coefficient was determined by a drawing load of 15 mm to 45 mm.

The results are summarized in Tables 3 and 4.

Tables show that each of the sheets of the present invention has a good surface appearance without non-coating, ripple, and galvannealing non-uniformity, includes the coating layer having the adequate Fe content and thicknesses of the ζ and Γ phase, and good press formability without problems in the powdering resistance and the friction property.

INDUSTRIAL APPLICABILITY

As described above, according to the present invention, there can be provided the galvannealed steel sheet having both excellent surface appearance and press formability by controlling the alloy elements in the steel sheet within the adequate range. Accordingly, in the present invention, the properties can be improved only by controlling the amounts of the alloy elements in the steel sheet. There can be provided a method for manufacturing the galvannealed steel sheet without requiring new steps and facilities, and with the stability in the operation.

TABLE 1

| Steel | C | Si | Mn | P | S | sol Al | Ti | Nb | N | B | Sb | Formula 1 | Formula 2 | Applied |
|---|---|---|---|---|---|---|---|---|---|---|---|---|---|---|
| 1 | 0.0020 | 0.005 | 0.10 | 0.010 | 0.007 | 0.032 | 0.013 | 0.011 | 0.0023 | — | — | 0.020 | −0.013 | Comp.Ex. |
| 2 | 0.0022 | 0.010 | 0.10 | 0.012 | 0.006 | 0.035 | 0.012 | 0.009 | 0.0023 | — | — | 0.027 | −0.014 | Comp.Ex. |
| 3 | 0.0021 | 0.019 | 0.11 | 0.011 | 0.008 | 0.033 | 0.013 | 0.010 | 0.0025 | — | — | 0.036 | −0.016 | Ex. |
| 4 | 0.0019 | 0.032 | 0.10 | 0.010 | 0.006 | 0.035 | 0.013 | 0.010 | 0.0023 | — | — | 0.047 | −0.011 | Ex. |
| 5 | 0.0022 | 0.040 | 0.10 | 0.010 | 0.006 | 0.033 | 0.012 | 0.009 | 0.0022 | — | — | 0.055 | −0.013 | Ex. |
| 6 | 0.0020 | 0.050 | 0.11 | 0.011 | 0.006 | 0.032 | 0.013 | 0.011 | 0.0022 | — | — | 0.027 | −0.016 | Comp.Ex |
| 7 | 0.0023 | 0.012 | 0.05 | 0.012 | 0.008 | 0.032 | 0.013 | 0.010 | 0.0023 | — | — | 0.027 | −0.016 | Comp.Ex |
| 8 | 0.0021 | 0.015 | 0.05 | 0.015 | 0.008 | 0.032 | 0.015 | 0.009 | 0.0023 | — | — | 0.033 | −0.013 | Ex. |
| 9 | 0.0022 | 0.011 | 0.17 | 0.011 | 0.006 | 0.033 | 0.014 | 0.010 | 0.0023 | — | — | 0.031 | −0.012 | Ex. |
| 10 | 0.0021 | 0.011 | 0.25 | 0.011 | 0.007 | 0.035 | 0.013 | 0.011 | 0.0024 | — | — | 0.035 | −0.014 | Ex. |
| 11 | 0.0020 | 0.010 | 0.30 | 0.012 | 0.007 | 0.034 | 0.012 | 0.011 | 0.0025 | — | — | 0.037 | −0.015 | Comp.Ex |
| 12 | 0.0020 | 0.012 | 0.62 | 0.010 | 0.007 | 0.033 | 0.013 | 0.009 | 0.0024 | — | — | 0.053 | −0.014 | Comp.Ex |
| 13 | 0.0021 | 0.011 | 0.10 | 0.006 | 0.006 | 0.032 | 0.015 | 0.010 | 0.0018 | — | — | 0.022 | −0.009 | Comp.Ex |
| 14 | 0.0021 | 0.010 | 0.11 | 0.015 | 0.008 | 0.033 | 0.014 | 0.011 | 0.0020 | — | — | 0.031 | −0.013 | Ex. |
| 15 | 0.0022 | 0.010 | 0.11 | 0.020 | 0.008 | 0.034 | 0.014 | 0.011 | 0.0020 | — | — | 0.036 | −0.014 | Ex. |
| 16 | 0.0021 | 0.011 | 0.11 | 0.030 | 0.009 | 0.033 | 0.014 | 0.011 | 0.0021 | — | — | 0.047 | −0.015 | Ex. |
| 17 | 0.0020 | 0.011 | 0.10 | 0.040 | 0.008 | 0.034 | 0.015 | 0.010 | 0.0020 | — | — | 0.056 | −0.012 | Comp.Ex |
| 18 | 0.0022 | 0.011 | 0.10 | 0.070 | 0.006 | 0.031 | 0.015 | 0.010 | 0.0021 | — | — | 0.086 | −0.010 | Comp.Ex |
| 19 | 0.0028 | 0.015 | 0.19 | 0.010 | 0.008 | 0.032 | 0.025 | 0.005 | 0.0019 | — | — | 0.035 | −0.005 | Ex. |
| 20 | 0.0028 | 0.015 | 0.21 | 0.015 | 0.009 | 0.031 | 0.023 | 0.006 | 0.0019 | — | — | 0.041 | −0.008 | Ex. |

Formula 1: Si+Mn/20+P
Formula 2: Ti−(48C/12+48N/14+48S/32)

TABLE 2

| Steel | C | So | Mn | P | S | sol Al | Ti | Nb | N | B | Sb | Formula 1 | Formula 2 | Applied |
|---|---|---|---|---|---|---|---|---|---|---|---|---|---|---|
| 21 | 0.0032 | 0.020 | 0.22 | 0.021 | 0.006 | 0.032 | 0.025 | 0.006 | 0.0021 | — | — | 0.052 | −0.004 | Ex. |
| 22 | 0.0033 | 0.030 | 0.11 | 0.030 | 0.007 | 0.033 | 0.042 | 0.005 | 0.0025 | — | — | 0.066 | 0.010 | Ex. |
| 23 | 0.0028 | 0.031 | 0.10 | 0.030 | 0.007 | 0.033 | 0.060 | 0.005 | 0.0025 | — | — | 0.066 | 0.030 | Ex. |
| 24 | 0.0030 | 0.040 | 0.19 | 0.030 | 0.007 | 0.033 | 0.024 | 0.005 | 0.0025 | — | — | 0.080 | −0.007 | Comp. Ex. |
| 25 | 0.0029 | 0.030 | 0.30 | 0.032 | 0.007 | 0.033 | 0.024 | 0.006 | 0.0024 | — | — | 0.077 | −0.006 | Comp. Ex. |
| 26 | 0.0028 | 0.020 | 0.21 | 0.021 | 0.011 | 0.042 | — | — | 0.0016 | — | — | 0.052 | — | Ex. |
| 27 | 0.0031 | 0.022 | 0.20 | 0.019 | 0.010 | 0.038 | 0.031 | — | 0.0019 | — | — | 0.051 | −0.003 | Ex. |
| 28 | 0.0032 | 0.020 | 0.19 | 0.019 | 0.012 | 0.038 | 0.050 | — | 0.0018 | — | — | 0.049 | 0.013 | Ex. |
| 29 | 0.0030 | 0.018 | 0.14 | 0.023 | 0.009 | 0.032 | — | 0.025 | 0.0018 | — | — | 0.048 | — | Ex. |
| 30 | 0.0030 | 0.019 | 0.14 | 0.019 | 0.010 | 0.035 | — | 0.040 | 0.0015 | — | — | 0.045 | — | Ex. |
| 31 | 0.0031 | 0.021 | 0.16 | 0.024 | 0.010 | 0.035 | 0.023 | 0.018 | 0.0023 | 0.0003 | — | 0.053 | −0.012 | Ex. |
| 32 | 0.0020 | 0.019 | 0.14 | 0.019 | 0.009 | 0.030 | 0.024 | 0.017 | 0.0025 | — | 0.010 | 0.045 | −0.006 | Ex. |
| 33 | 0.0022 | 0.019 | 0.14 | 0.019 | 0.008 | 0.030 | 0.024 | 0.019 | 0.0021 | — | 0.050 | 0.045 | −0.004 | Ex. |
| 34 | 0.0049 | 0.020 | 0.12 | 0.025 | 0.006 | 0.050 | 0.035 | 0.005 | 0.0028 | — | — | 0.051 | −0.003 | Ex. |
| 35 | 0.0049 | 0.020 | 0.12 | 0.025 | 0.006 | 0.049 | 0.048 | 0.010 | 0.0028 | — | — | 0.051 | 0.010 | Ex. |

Formula 1: Si+Mn/20+P
Formula 2: Ti−(48C/12+48N/14+48S/32)

TABLE 3

| No. | Steel | Galvannealing temp. (° C.) | Galvannealing time (s) | Non-coating, ripple | Galvannealing non-uniformity | Coating weight (g/m$^2$) | Fe content in coating layer (%) | ζ phase thickness | Γ phase thickness | Powdering resistance | Friction property: friction coefficient | Overall judgement | Applied |
|---|---|---|---|---|---|---|---|---|---|---|---|---|---|
| 1 | 1 | 500 | 12 | ○ | ○ | 50 | 14.2 | 0.15 | 3.0 | 5 | 0.138 | x | Comp. Ex. |
| 2 | 1 | 495 | 12 | ○ | ○ | 48 | 11.0 | 0.60 | 1.5 | 2 | 0.143 | x | Comp. Ex. |
| 3 | 2 | 505 | 12 | ○ | ○ | 49 | 13.5 | 0.25 | 2.1 | 4 | 0.131 | Δ | Comp. Ex. |
| 4 | 3 | 510 | 12 | ○ | ○ | 52 | 12.5 | 0.10 | 1.2 | 2 | 0.130 | ○ | Ex. |
| 5 | 4 | 515 | 15 | ○ | ○ | 46 | 11.4 | 0.10 | 0.9 | 1 | 0.128 | ○ | Ex. |
| 6 | 4 | 525 | 10 | ○ | ○ | 49 | 13.5 | 0.04 | 2.5 | 3 | 0.125 | ○ | Ex. |
| 7 | 5 | 515 | 12 | ○ | ○ | 45 | 10.2 | 0.10 | 0.7 | 1 | 0.130 | ○ | Ex. |
| 8 | 6 | 520 | 12 | Δ | ○ | 49 | 9.4 | 0.10 | 0.5 | 2 | 0.127 | Δ | Comp. Ex. |
| 9 | 7 | 505 | 15 | ○ | ○ | 50 | 13.8 | 0.20 | 2.7 | 4 | 0.136 | x | Comp. Ex. |
| 10 | 7 | 495 | 12 | ○ | ○ | 50 | 10.9 | 0.85 | 1.8 | 2 | 0.155 | x | Comp. Ex. |
| 11 | 8 | 500 | 12 | ○ | ○ | 51 | 12.0 | 0.05 | 1.1 | 1 | 0.130 | ◎ | Ex. |
| 12 | 8 | 520 | 12 | ○ | ○ | 47 | 14.0 | 0.02 | 1.6 | 2 | 0.125 | ○ | Ex. |
| 13 | 9 | 505 | 15 | ○ | ○ | 48 | 12.1 | 0.04 | 1.8 | 2 | 0.131 | ○ | Ex. |
| 14 | 10 | 510 | 10 | ○ | ○ | 53 | 10.5 | 0.06 | 0.9 | 1 | 0.132 | ○ | Ex. |
| 15 | 11 | 505 | 12 | Δ | ○ | 49 | 10.5 | 0.10 | 1.0 | 1 | 0.133 | Δ | Comp. Ex. |
| 16 | 12 | 520 | 10 | x | ○ | 43 | 10.8 | 0.02 | 1.5 | 2 | 0.128 | x | Comp. Ex. |
| 17 | 13 | 500 | 15 | ○ | ○ | 45 | 13.5 | 0.03 | 3.1 | 4 | 0.135 | Δ | Comp. Ex. |
| 18 | 14 | 495 | 15 | ○ | ○ | 46 | 10.8 | 0.08 | 0.5 | 1 | 0.129 | ○ | Ex. |
| 19 | 15 | 505 | 10 | ○ | ○ | 25 | 13.3 | 0.01 | 0.9 | 1 | 0.123 | ◎ | Ex. |

TABLE 3-continued

| No. | Steel | Galvanneal-ing temp. (° C.) | Gal-vanne-aling time (s) | Non-coating, ripple | Galvanneal-ing non-uniformity | Coating weight (g/m²) | Fe content in coating layer (%) | ζ phase thickness | Γ phase thickness | Powdering resistance | Friction property: friction coefficient | Over-all judge-ment | Applied |
|---|---|---|---|---|---|---|---|---|---|---|---|---|---|
| 20 | 15 | 505 | 15 | ○ | ○ | 45 | 11.2 | 0.10 | 1.0 | 1 | 0.125 | ◎ | Ex. |
| 21 | 15 | 515 | 15 | ○ | ○ | 65 | 9.2 | 0.60 | 1.2 | 1 | 0.129 | ○ | Ex. |
| 22 | 15 | 525 | 10 | ○ | ○ | 52 | 13.8 | 0.08 | 1.8 | 3 | 0.124 | ○ | Ex. |

TABLE 4

| No. | Steel | Gal-vannea-ling temp. (° C.) | Gal-vannea-aling time (s) | Non-coating, ripple | Gal-vanneal-ing non-uniformity | Coating weight (g/m²) | Fe content in coating layer (%) | ζ phase thickness | Γ phase thickness | Powdering resistance | Friction property: friction coefficient | Over-rall judge-ment | Applied |
|---|---|---|---|---|---|---|---|---|---|---|---|---|---|
| 23 | 16 | 505 | 12 | ○ | ○ | 50 | 10.9 | 0.03 | 0.9 | 1 | 0.126 | ◎ | Ex. |
| 24 | 17 | 510 | 12 | Δ | ○ | 48 | 10.2 | 0.10 | 0.9 | 1 | 0.131 | Δ | Comp. Ex. |
| 25 | 18 | 520 | 15 | x | x | 48 | 7.8 | 2.50 | 0.2 | 1 | 0.25*) | x | Comp. Ex. |
| 26 | 19 | 505 | 12 | ○ | ○ | 50 | 12.1 | 0.12 | 1.5 | 2 | 0.127 | ○ | Ex. |
| 27 | 20 | 515 | 12 | ○ | ○ | 47 | 12.0 | 0.08 | 1.3 | 1 | 0.125 | ◎ | Ex. |
| 28 | 21 | 515 | 15 | ○ | ○ | 47 | 11.4 | 0.04 | 1.2 | 1 | 0.126 | ◎ | Ex. |
| 29 | 21 | 525 | 12 | ○ | ○ | 46 | 13.0 | 0.03 | 1.5 | 2 | 0.125 | ○ | Ex. |
| 30 | 21 | 530 | 10 | ○ | ○ | 45 | 13.9 | 0.02 | 2.0 | 3 | 0.123 | ○ | Ex. |
| 31 | 22 | 520 | 12 | ○ | ○ | 48 | 10.6 | 0.05 | 1.1 | 1 | 0.123 | ◎ | Ex. |
| 32 | 23 | 520 | 15 | ○ | ○ | 48 | 11.5 | 0.0 | 1.5 | 2 | 0.122 | ○ | Ex. |
| 33 | 24 | 520 | 15 | ○ | x | 48 | 7.6 | 2.60 | 0.1 | 1 | 0.30*) | x | Comp. Ex. |
| 34 | 25 | 520 | 15 | ○ | x | 49 | 8.3 | 1.60 | 0.3 | 1 | 0.22*) | x | Comp. Ex. |
| 35 | 26 | 510 | 12 | ○ | ○ | 47 | 10.5 | 0.02 | 1.0 | 1 | 0.125 | ◎ | Ex. |
| 36 | 27 | 510 | 12 | ○ | ○ | 48 | 10.9 | 0.05 | 0.8 | 1 | 0.123 | ◎ | Ex. |
| 37 | 28 | 520 | 12 | ○ | ○ | 48 | 12.2 | 0.03 | 1.9 | 2 | 0.130 | ○ | Ex. |
| 38 | 29 | 515 | 15 | ○ | ○ | 49 | 11.1 | 0.03 | 0.9 | 1 | 0.125 | ◎ | Ex. |
| 39 | 30 | 515 | 15 | ○ | ○ | 47 | 11.3 | 0.06 | 0.8 | 1 | 0.126 | ◎ | Ex. |
| 40 | 31 | 520 | 12 | ○ | ○ | 50 | 10.8 | 0.08 | 0.6 | 1 | 0.124 | ◎ | Ex. |
| 41 | 32 | 520 | 10 | ○ | ○ | 51 | 10.9 | 0.03 | 0.8 | 1 | 0.125 | ◎ | Ex. |
| 42 | 33 | 510 | 12 | ○ | ○ | 48 | 11.2 | 0.05 | 1.1 | 1 | 0.122 | ◎ | Ex. |
| 43 | 34 | 515 | 15 | ○ | ○ | 48 | 10.8 | 0.06 | 0.3 | 1 | 0.123 | ◎ | Ex. |
| 44 | 35 | 515 | 12 | ○ | ○ | 48 | 11.6 | 0.02 | 0.4 | 1 | 0.122 | ◎ | Ex. |

What is claimed is:

1. A galvannealed steel sheet having excellent surface appearance and press formability, characterized in that a steel sheet comprises galvannealed layer at least one surface of the steel sheet, the steel sheet comprising 0.001 to 0.005% by mass of C, 0.010 to 0.040% by mass of Si, 0.05 to 0.25% by mass of Mn, and 0.010 to 0.10% by mass of Sb, and 0.010 to 0.030% by mass of P, wherein, the Si, Mn, and P satisfy the relation 0.030%≦Si+P+Mn/20≦0.070%, and the layer deposits in the amount of 25 to 60 g/m², contains 9 to 14% of Fe, and has ζ phase with a thickness of 0.5 μm or less, and a Γ phase with a thickness of 1.5 μm or less.

2. A galvannealed steel sheet having excellent surface appearance and press formability according to claim 1, wherein the steel sheet further comprises one or two of 0.010 to 0.060% by mass of Ti and 0.005 to 0.040% by mass of Nb.

3. A galvannealed steel sheet having excellent surface appearance and press formability according to claim 2, wherein the Ti and Nb satisfy the relation 0.015%≦Ti+Nb≦0.050%, and 0.010%≧Ti−(48C/12+48S/32+48N/14).

4. A galvannealed steel sheet having excellent surface appearance and press formability, characterized in that a steel sheet comprises galvannealed layer at least one surface of the steel sheet, the steel sheet comprising 0.001 to 0.005% by mass of C, 0.010 to 0.040% by mass of Si, 0.05 to 0.25% by mass of Mn, and 0.10 to 0.030% mass of P, wherein the Si, Mn, P satisfy the relation 0.030%≦Si+P+Mn/20≦0.070%, wherein the layer deposits in the amount of 25 to 60 g/m², contains 9 14% of Fe, and has a ζ phase with a thickness of 0.5 μm or less, and a Γ r phase with a thickness of 1.5 μm or less.

5. A galvannealed steel sheet having excellent surface appearance and press formability according to claim 4, wherein the steel sheet further comprises one or two of 0.010 to 0.060% by mass of Ti and 0.005 to 0.040% by mass of Nb.

6. A galvannealed steel sheet having excellent surface appearance and press formability according to claim 5, wherein the Ti and Nb satisfy the relation 0.015%≦Ti+Nb≦0.050%, and 0.010%≧Ti−(48C/12+48S/32+48N/14).

* * * * *